US009308736B2

(12) United States Patent
Momose

(10) Patent No.: US 9,308,736 B2
(45) Date of Patent: Apr. 12, 2016

(54) RECORDING APPARATUS

(71) Applicant: SEIKO EPSON CORPORATION, Tokyo (JP)

(72) Inventor: Isao Momose, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/605,775

(22) Filed: Jan. 26, 2015

(65) Prior Publication Data

US 2015/0210083 A1 Jul. 30, 2015

(30) Foreign Application Priority Data

Jan. 27, 2014 (JP) ..... 2014-012128

(51) Int. Cl.
*B41J 2/175* (2006.01)
*B41J 29/02* (2006.01)
*B41J 29/13* (2006.01)

(52) U.S. Cl.
CPC ..... *B41J 2/17553* (2013.01); *B41J 2/17513* (2013.01); *B41J 2/17523* (2013.01); *B41J 29/02* (2013.01); *B41J 29/13* (2013.01)

(58) Field of Classification Search
CPC ..... B41J 2/175; B41J 2/1752; B41J 2/17553
USPC ..... 347/86
See application file for complete search history.

(56) References Cited

U.S. PATENT DOCUMENTS 4,079,384 A * 3/1978 Takano et al. ..... 347/86
2003/0184771 A1 10/2003 Yamamoto et al.
2005/0088493 A1 4/2005 Koga
2005/0231567 A1 10/2005 Koga
2010/0225726 A1* 9/2010 Chan et al. ..... 347/108

FOREIGN PATENT DOCUMENTS

JP 2013-121659 6/2013

* cited by examiner

*Primary Examiner* — Justin Seo
*Assistant Examiner* — Michael Konczal
(74) *Attorney, Agent, or Firm* — Workman Nydegger

(57) ABSTRACT

A recording apparatus includes a recording head that is disposed inside an apparatus housing and that ejects a liquid onto a medium; a liquid container attaching/detaching unit that is configured such that a liquid container which contains the liquid is attached/detached to/from the liquid container attaching/detaching unit itself and that is configured to be inserted/extracted through an inserting/extracting opening provided in the apparatus housing; and a liquid feeding path that feeds the liquid from the liquid container to the recording head. A unit-side path and an apparatus-housing-side path which constitute the liquid feeding path are mutually connected by the insertion of the liquid container attaching/detaching unit through the inserting/extracting opening of the apparatus housing, and the mutual connection is disconnected by the extraction of the liquid container attaching/detaching unit through the inserting/extracting opening of the apparatus housing.

14 Claims, 6 Drawing Sheets

RECORDING APPARATUS

BACKGROUND

1. Technical Field

The present invention relates to a recording apparatus, such as an ink jet printer.

2. Related Art

Heretofore, as a kind of recording apparatus, an ink jet printer which performs recording (printing) by causing a recording head thereof to eject ink onto a medium, such as paper, is well known. In such a printer, when performing a relatively large amount of printing, it becomes necessary to feed ink to a recording head continuously and stably. For this reason, among printers of this type, there is a printer configured such that a large-capacity liquid container containing an ink pack or the like therein is provided outside the apparatus housing of the printer, and ink is fed from the large-capacity liquid container to a recording head disposed inside the apparatus housing through an ink feeding tube (for example, refer to JP-A-2013-121659).

In such a printer described above, a liquid container is disposed outside the apparatus housing. For this reason, there is a problem that the installation area of the entire printer increases by an area equal to the installation area of the liquid container and which must be added to the installation area of the apparatus housing. Under such a situation, in order to solve the problem described above, an arrangement, in which a liquid container is disposed inside the apparatus housing, and in the inside of the apparatus housing, ink is fed from the liquid container to a recording head through an ink feeding tube, has been conceived.

When, however, such an arrangement is implemented, since the liquid container requires a replacement task to be performed, there arises a new problem in that, when the replacement task is carried out, connecting the liquid container to the ink feeding tube can become difficult.

In addition, such a problem is relatively common with respect to not only an ink jet printer, but also a recording apparatus configured such that a liquid container, which contains liquid to be fed to a recording head disposed inside the apparatus housing, is also disposed inside the apparatus housing, and a liquid feeding path connecting the liquid container to the recording head is provided.

SUMMARY

An advantage of some aspects of the invention is that a recording apparatus is provided which makes it possible to, without increasing the installation area of the entire apparatus, easily feed ink to a recording head disposed inside the apparatus housing from a liquid container which is likewise disposed inside the apparatus housing.

Hereinafter, means for realizing such a recording apparatus as well as the effects thereof will be described.

A recording apparatus according to an aspect of the invention includes a recording head that is disposed inside an apparatus housing and that ejects a liquid onto a medium; a liquid container attaching/detaching unit that is configured such that a liquid container which contains the liquid is attached/detached to/from the liquid container attaching/detaching unit itself and that is configured to be inserted/extracted through an inserting/extracting opening provided in the apparatus housing; and a liquid feeding path that feeds the liquid from the liquid container to the recording head. Further, the liquid feeding path encompasses a unit-side path provided in the liquid container attaching/detaching unit and an apparatus-housing-side path provided in the apparatus housing. Further, the unit-side path and the apparatus-housing-side path are mutually connected by the insertion of the liquid container attaching/detaching unit through the inserting/extracting opening of the apparatus housing, and the mutual connection is disconnected by the extraction of the liquid container attaching/detaching unit through the inserting/extracting opening of the apparatus housing.

According to this configuration, it is possible to easily attach/detach the liquid container to/from the liquid container attaching/detaching unit in a state of having being extracted through the inserting/extracting opening. Further, when the liquid container attaching/detaching unit containing the liquid container attached therein has been inserted through the inserting/extracting opening, the unit-side path and the apparatus-housing-side path, which separately constitute the liquid feeding path, are connected to each other and, as a result, it becomes possible to feed the liquid from the liquid container to the recording head. Further, in such a case, since the liquid container is disposed inside the apparatus housing, the installation area of the entire recording apparatus does not increase. Accordingly, it is possible to, without increasing the installation area of the entire apparatus, easily feed the liquid to the recording head from the liquid container, which is likewise disposed inside the apparatus housing, through the liquid feeding path.

Further, in the recording apparatus according to the above aspect of the invention, preferably, each of a unit-side connection portion constituting the unit-side path and connected to the apparatus-housing-side path and an apparatus-housing-side connection portion constituting the apparatus-housing-side path and connected to the unit-side path includes a valve mechanism which is opened when both of the unit-side connection portion and the apparatus-housing-side connection portion are connected to each other, and which is closed when both of the unit-side connection portion and the apparatus-housing-side connection portion are disconnected from each other.

According to this configuration, when the liquid container attaching/detaching unit containing the liquid container therein has been inserted through the inserting/extracting opening and the unit-side connection portion and the apparatus-side connection portion become mutually connected, the valve mechanism provided in both connection portions is open state. Thus, the unit-side path and the apparatus-housing-side path are connected to each other and, as a result, it becomes possible to feed the liquid from the liquid container to the recording head. In contrast, when the liquid container attaching/detaching unit is extracted through the inserting/extracting opening and both of the connection portions are disconnected from each other, the valve mechanism provided in both connection portions becomes closed. Thus, when, for example, for the purpose of attachment/detachment replacement of the liquid container, the liquid container attaching/detaching unit has been extracted through the inserting/extracting opening of the apparatus housing, it is possible to suppress the ink from leaking from the unit-side path and the apparatus-housing-side path.

Further, preferably, the recording apparatus according to the above aspect of the invention further includes a movement resistance applying portion that, before the unit-side path and the apparatus-housing-side path are mutually connected after initiating the insertion of the liquid container attaching/detaching unit through the inserting/extracting opening, makes contact with and applies a movement resistance force to the liquid container attaching/detaching unit while moving in an insertion direction in which the liquid container attaching/ detaching unit is inserted, and the liquid container attaching/detaching unit further moves in the insertion direction while moving against the movement resistance force applied by the movement resistance applying portion, and the movement of the liquid container attaching/detaching unit brings the unit-side path into contact with the apparatus-housing-side path.

According to this configuration, even when the liquid container attaching/detaching unit has been extracted forcibly by a user through the inserting/extracting opening of the apparatus housing, it is possible to prevent, by utilizing the movement resistance applying portion, the occurrence of a situation in which the unit-side connection portion and the apparatus-housing-side connection portion collide with each other due to the force applied by the user.

Further, in the recording apparatus according to the above aspect of the invention, preferably, the movement resistance applying portion is configured to include a force applying member that, when the movement resistance applying portion is in contact with the liquid container attaching/detaching unit which further moves in the insertion direction, applies an energizing force to the liquid container attaching/detaching unit in a direction in which the liquid container attaching/detaching unit is extracted through the inserting/extracting opening, and that, when the movement resistance applying portion is in contact with the liquid container attaching/detaching unit and the unit-side path and the apparatus-housing-side path are connected to each other, enters a force accumulation state.

According to this configuration, when the liquid container attaching/detaching unit is extracted through the inserting/extracting opening, the force applying member enters a state in which an accumulated force is released as an energizing force applied in the extraction direction, and thus, an operation of extracting the liquid container attaching/detaching unit becomes easy.

Further, in the recording apparatus according to the above aspect of the invention, preferably, the liquid container attaching/detaching unit further includes a pump mechanism that is driven in order to cause the liquid to move and flow, through the unit-side path, from an upstream side, at which the liquid container is disposed, toward a downstream side.

According to this configuration, for example, even when the liquid container attaching/detaching unit is disposed at a lower portion in the vertical direction in the apparatus housing; while the recording head is disposed at an upper portion in the vertical direction in the apparatus housing, it is possible to smoothly feed ink from the liquid container attached to the liquid container attaching/detaching unit to the recording head by utilizing the drive of the pump mechanism.

Further, in the recording apparatus according to the above aspect of the invention, preferably, in the liquid container attaching/detaching unit, a plurality of liquid containers including the liquid container are attached/detached to/from the liquid container attaching/detaching unit itself, and a plurality of unit-side paths which include the unit-side path and each of which is associated with a corresponding one of the plurality of liquid containers are provided; while, in the apparatus housing, a plurality of apparatus-housing-side paths which include the apparatus-housing-side path and each of which is associated with a corresponding one of the plurality of unit-side paths, are provided.

According to this configuration, it is possible to perform multi-color recording with a plurality of inks onto a medium.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, a recording apparatus according to an embodiment will be described with reference to the drawings. In addition, the recording apparatus according to this embodiment is, for example, an ink jet printer which performs recording (printing) by ejecting ink, which is an example liquid, onto a medium, such as paper. In addition, hereinafter, when describing a direction, unless otherwise noted, the description will be made on the basis of directions shown in FIG. 1.

Figure 1:
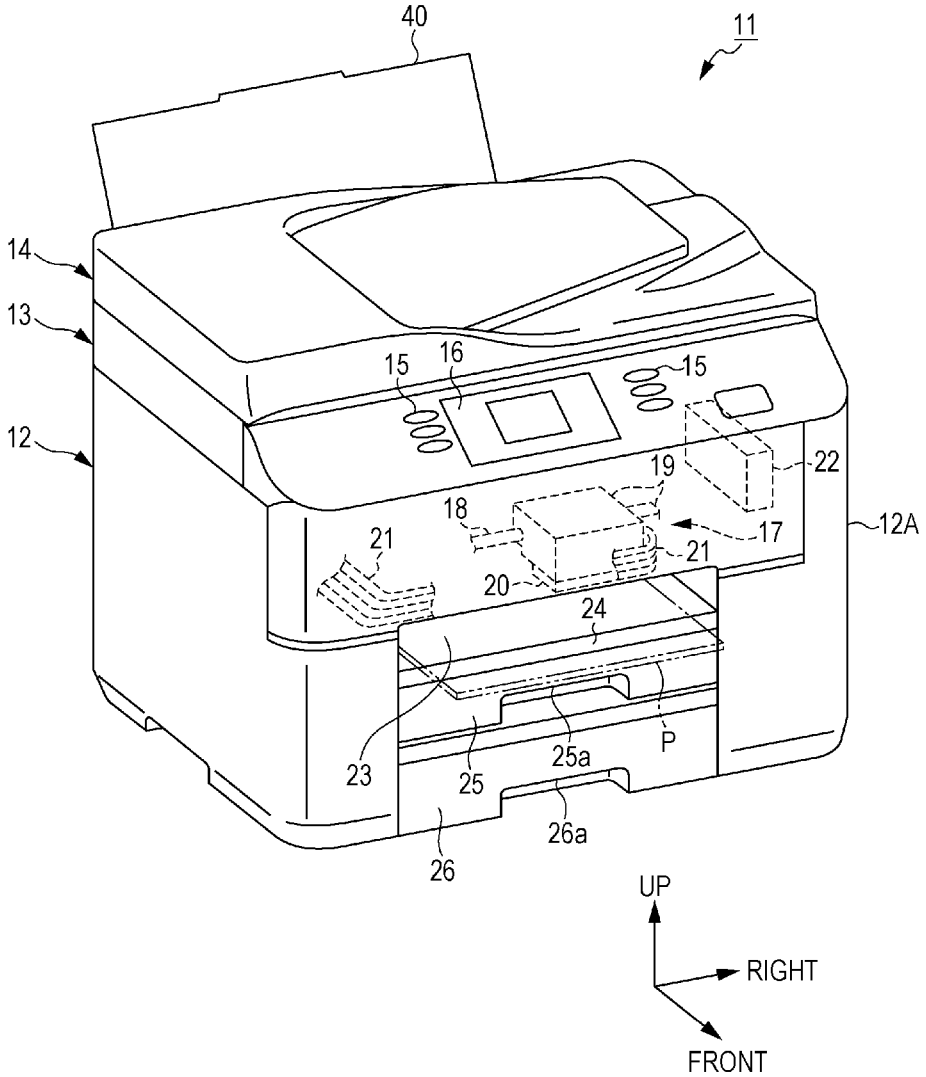
FIG. 1 is a perspective view of a recording apparatus according to an embodiment of the invention when the recording apparatus is seen obliquely from the front upper left side thereof.

As shown in FIG. 1, a multifunction printer 11 includes a recording apparatus 12 that performs a recording operation by ejecting ink; a reading apparatus 13 that reads information recorded on a printing medium (omitted from illustration); and an automatic printing medium feeding portion 14 capable of feeding a plurality of printing media stacked in layers to the reading apparatus 13 on a sheet-by-sheet basis. The reading apparatus 13 is disposed on a box-shaped apparatus housing 12A of the recording apparatus 12; and the automatic printing medium feeding portion 14 is disposed on the reading apparatus 13. At an upper front portion of the apparatus housing 12A of the recording apparatus 12, there are provided an operation portion 15 which is operated by a user who desires to input information to the multifunction printer 11, and a display portion 16 on which various information pieces are displayed. Further, in the inside of the apparatus housing 12A there is provided a recording portion 17 that performs recording by ejecting ink onto paper P having been fed.

That is, in the inside of the apparatus housing 12A, a guide shaft 18 is disposed between both side faces of the apparatus housing 12A so as to extend along the leftward/rightward direction, which is a main scanning direction relative to the paper P, and a carriage 19 is supported by the guide shaft 18 so as to be capable of moving along the main scanning direction. This carriage 19 reciprocates along the main scanning direction by being driven by a carriage motor (not illustrated). Further, a recording head 12 that performs recording by ejecting ink onto the paper P is attached to the lower face of the carriage 19.

In addition, although not illustrated, a plurality of nozzle rows each constituted of a plurality of nozzles through each of which ink is ejected are provided on the recording head 12. Further, ink feeding tubes 21 as an example of the plurality of liquid feeding paths are routed inside the apparatus housing 12A in a state in which the downstream edge of each of the ink feeding tubes 21 is connected to the recording head 12 so as to be associated with a corresponding one of the plurality of nozzle rows. Further, in the inside of the apparatus housing 12A, a board unit 12, which functions as a control unit provided with driving circuits for driving a movement mechanism of the carriage 19, an ink ejection mechanism for the recording head 12, and the like, is disposed at a right side position of the right-side edge of an area which is along the main scanning direction and within which the carriage 19 moves.

Figure 2:
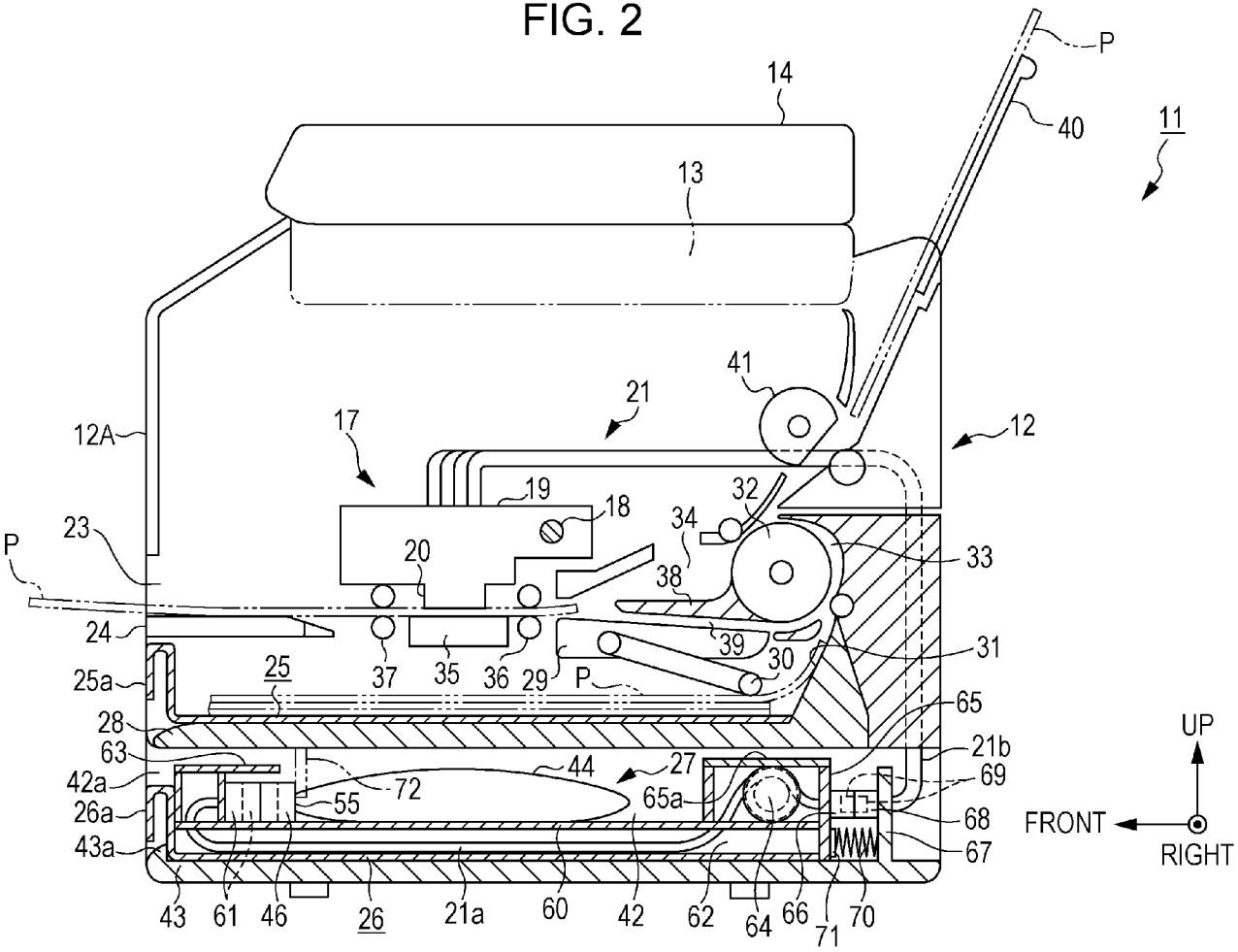
FIG. 2 is a schematic cross-sectional view illustrating an internal configuration of the same recording apparatus.

As shown in FIGS. 1 and 2, a paper ejecting opening 23 capable of ejecting the paper P which is ejected from the recording portion 17 to the outside of the apparatus housing 12A is provided at the front side of the apparatus housing 12A. Further, in the inside of this paper ejection opening 23, a paper catch tray 24 capable of catching the paper P, which is ejected from the recording portion 17 inside the apparatus housing 12A to the outside of the apparatus housing 12A, is provided. Further, in the apparatus housing 12A, a paper feeding cassette 25 and a liquid container attaching/detaching unit 26 are disposed at respective lower side positions of the paper catch tray 24 so as to be capable of being freely inserted/extracted into/from the apparatus housing 12A. The feeding cassette 25 is capable of containing the paper P to be fed to the recording portion 17, in a state in which the paper P is stacked in layers. Further, the liquid container attaching/detaching unit 26 contains a liquid container 27 containing ink to be fed to the recording head 20, in a state in which the liquid container 27 is attachable/detachable to/from the liquid container attaching/detaching unit 26 itself.

As shown in FIG. 2, in the inside of the apparatus housing 12A, an area where the paper feeding cassette 25 is disposed and an area where the liquid container attaching/detaching unit 26 is disposed are partitioned by a partitioning wall 28 in the upward/downward direction. The paper feeding cassette 25 is capable of freely moving along the upper face of the partitioning wall 28 in an insertion/extraction direction in which insertion/extraction into/from the apparatus housing 12A is performed. In addition, an eave-shaped gripper 25*a* gripped by a user when performing insertion/extraction of the paper feeding cassette 25 into/from the apparatus housing 12A is provided at the front edge of the paper feeding cassette 25. Similarly, an eave-shaped gripper 26*a* gripped by a user when performing insertion/extraction of the liquid container attaching/detaching unit 26 to/from the apparatus housing 12A is provided at the front edge of the liquid container attaching/detaching unit 26.

Further, in an inner portion inside the apparatus housing 12A when viewed inward from the paper ejecting opening 23, a path constituting member 29 whose upper face forms a portion of a transportation path for the paper P is provided, and a roller 30 is pivotally supported by the path constituting member 29 so as to be capable of freely swinging. Further, in the inside of the apparatus housing 12A, a separation slope 31 whose gradient rises in the backward direction is provided behind the paper feeding roller 30. Further, a curved transportation path 33 which extends from the separation slope 31 obliquely upward along the outer circumferential face of a reverse rotation roller 32 is formed, and further, a transportation path 34 which is continuous with the curved transportation path 33 and which is also capable of transporting the paper P toward the recording portion 17 is formed.

In the recording portion 17, a supporting table 35 capable of supporting the paper P is provided at a position facing the recording head 20 in the upward/downward direction, and a paper feeding roller pair 36 and a paper ejecting roller pair 37 are disposed at a backward position and a forward position, respectively, which interpose the supporting table 35 therebetween. Further, in the inside of the apparatus housing 12A, a transportation path 39 is formed between the lower face of a frame 38, which supports the reverse rotation roller 32, and the upper face of the path constituting member 29. The transportation path 39 makes it possible to, without causing the paper P to passing through the curved transportation path 33, transport the paper P from the upper face of the supporting table 35 toward a portion at which the separation slope 31 and the curved transportation path 33 are continuous with each other.

That is, in FIG. 2, when the paper feeding roller 30 is rotated by being driven by a paper feeding-out motor (not illustrated), the paper P, which is stacked in layers inside the paper feeding cassette 25, is fed out toward the separation slope 31 which is located at a back side position of the paper feeding roller 30. Further, the paper P having been separated into single sheets at the separation slope 31 is transported to the recording unit 17 via the curved transportation path 33 and the transportation path 34, and at the recording portion 17, ink is ejected onto the upward facing obverse face of the paper P. Further, the paper P on which printing has been performed by the ejection of ink is ejected from the paper ejecting opening 23 by the rotation of the paper ejecting roller pair 37.

Further, when double-sided printing is performed, reverse rotation of the paper feeding roller pair 36 causes the paper P, whose obverse side has been subjected to printing, to pass through the transportation path 39; return to the position at which the separation slope 31 and the curved transportation path 33 become continuous with each other; and be transported again toward the recording unit 17 via the curved transportation path 33, in a state in which the obverse and reverse sides of the paper P are turned upside down. As a result, double-sided printing is performed at the printing portion 17 by the ejection of ink onto the upward facing reverse face of the paper P, and subsequently, the paper is ejected from the paper ejecting opening 23 by the rotation of the paper ejecting roller pair 37.

In addition, as shown in FIGS. 1 and 2, a mounting tray 40 is provided at the upper portion of the back side of the apparatus housing 12A. This mounting tray 40 is capable of mounting the paper P thereon when the paper p is fed from the upper backward portion of the apparatus housing 12A toward the recording portion 17. Further, the paper P mounted on this mounting tray 40 is caused to enter a midway position on the transportation path 34 from an oblique upper direction by the rotation of the paper feeding roller 41, and the entered paper P is transported toward the recording unit 17 by the rotation of the paper feeding roller pair 36.

As shown in FIG. 2, a space located at the lower side of the partitioning wall 28 inside the apparatus housing 12A is a mounting portion 42 for mounting the liquid container attaching/detaching unit 26, which can be freely inserted/extracted into/from the mounting portion 42 along the upper face of the bottom wall of the apparatus housing 12A through an inserting/extracting opening 42*a* which is an opening located at the front edge side of the mounting portion 42. Incidentally, the liquid container attaching/detaching unit 26 forms a rectangular-box shape whose size in the frontward/backward direction is long and which has a bottom face and an open top face. Further, in the inside of the liquid container attaching/detaching unit 26, the liquid container 27 is mounted so as to be freely attachable/detachable to/from the liquid container attaching/detaching unit 26.

Figure 3:
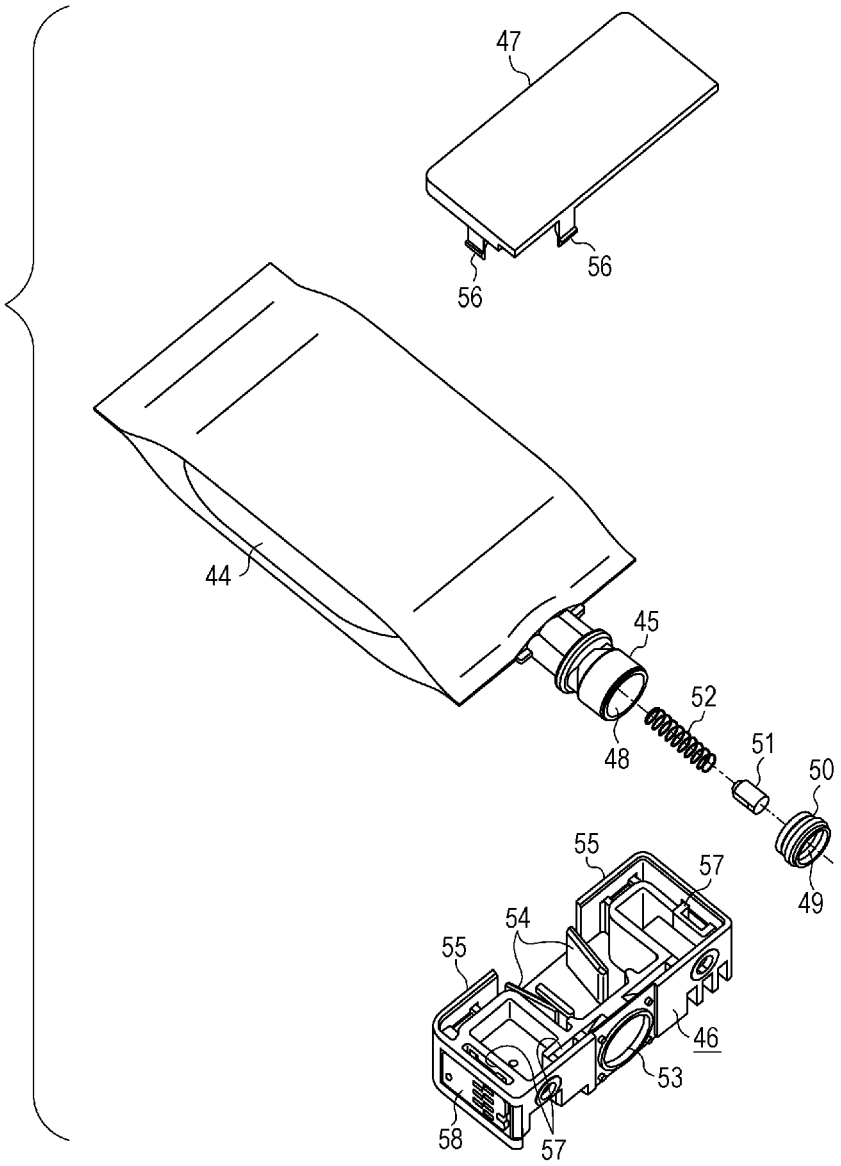
FIG. 3 is a disassembled perspective view of a liquid container according to an embodiment of the invention.

As shown in FIG. 3, the liquid container 27 includes an ink pack 44 which has flexibility and contains ink therein; a tube-shaped liquid lead-out member 45 which communicates between the inside and the outside of the ink pack 44, in the state of being projected from the ink pack 44; an attachment 46 which holds the ink pack 44 through the liquid lead-out member 45; and a cover 47 for the attachment 46. An edge opening of the liquid lead-out member 45 of the ink pack 44 is a liquid lead-out opening 48. Further, in the inside of the liquid lead-out opening 48, there are installed a shieling member 50 including a feeding hole 49 at the central portion thereof; a valve 51 capable of opening/closing the feeding hole 49; and a coil spring 52 which energizes the valve 51 toward the shieling member 50 side. That is, the ink pack 44 is capable of guiding out ink contained therein from the liquid lead-out opening 48 when the valve 51, which closes the feeding hole 49 of the shieling member 50 in a normal state, is caused to open the feeding hole 49 by being pushed by a liquid feeding member, such as an ink feeding needle (omitted from illustration), having been inserted into the liquid lead-out opening 48.

Further, the attachment 46 is a rectangular-shaped resin member which is more rigid than the ink pack 44, and is provided, at the front side thereof, with an opening 53 capable of, in a state of holding the ink pack 44, exposing the liquid lead-out opening 48 of the liquid lead-out member 45. Further, at the back side of the opening 53, a pair of ribs 54 capable of pinching the liquid lead-out member 45 of the ink pack 44 from both of the left and right sides are provided, and further, each of vertical walls 55 is formed at a corresponding one of the left side of one of the ribs 54 and the right side of the other one of the ribs 54 so as to extend in the leftward/rightward direction. Further, the attachment 46 includes latching concave portions 57 formed thereon, each of which is capable of latching a corresponding one of latching convex portions 56 formed on the cover 47. Further, the attachment 46 is provided, at a side face thereof, with a connection terminal 58 including a circuit board (omitted from illustration) on which a circuit stores therein pieces of information related to a kind of ink, a remaining amount of ink contained in the ink pack 44, and the like.

Next, the liquid container attaching/detaching unit 26 as well as a liquid feeding path which connects the recording head 20 to the liquid container 27 mounted in the liquid container attaching/detaching unit 26 will be described in detail.

As shown in FIG. 2, the liquid container attaching/detaching unit 26 is structured so as to be partitioned into two layers of an upper layer and a lower layer by a supporting plate 60, and the liquid container 27 is attached to the supporting plate 60 so as to be mounted thereon. Further, a sliding member 61 is disposed at a front portion on the supporting plate 60 so as to be capable of freely moving in the frontward/backward direction between a position denoted by a chain double-dashed line and a position denoted by a full line in FIG. 2. This sliding member 61 is a member provided therein with the ink feeding needle (omitted from illustration) which is inserted into the liquid lead-out opening 48 of the ink pack 44, and the sliding member 61 is normally stayed at the position denoted by the chain double-dashed line, in the state of being energized by a spring (omitted from illustration). Further, when having been pushed by the attachment 46 of the liquid container 27 in the frontward direction while moving against the energizing force of the spring, the sliding member 61 moves from the position denoted by the chain double-dashed line to the position denoted by the full line.

Further, in the inside of the sliding member 61, the upstream edge of an ink feeding tube 21*a* is connected to the base edge side of the ink feeding needle (i.e., the opposite side of the ink feeding needle's tip inserted into the liquid lead-out opening 48 of the ink pack 44). Further, this ink feeding tube 21*a* is pulled into a lower layer chamber 62, a space formed at the lower side of the supporting plate 60, at a front side position of the sliding member 61, and further, the ink feeding tube 21*a* is pulled out again toward the upper side of the supporting plate 60 at a back side position of the ink pack 44. In addition, at a position above a connection portion where the ink feeding tube 21*a* is connected to the sliding member 61 and a contact portion where the attachment 46 of the liquid container 27 is in contact with the sliding member 61, a blindfold plate 63 is provided so as to, when the liquid container attaching/detaching unit 26 is in the state of being extracted through the inserting/extracting opening 42*a*, cause these connection and contact portions to be invisible from a user.

As shown in FIG. 2, the ink feeding tube 21*a* having been pulled out toward the upper side of the supporting plate 60 from the lower layer chamber 62 side of the liquid container attaching/detaching unit 26 reaches a unit-side connection portion 66, which is attached to the back face of a backward wall 65 of the liquid container attaching/detaching unit 26, via a pump mechanism 64 which is provided with a tube pump and the like and which is disposed on the supporting plate 60, and the downstream edge of the ink feeding tube 21*a* is connected to the unit-side connection portion 66. In addition, at a position above a portion where the ink feeding tube 21*a* is pulled toward the upper side of the supporting plate 60 from the lower layer chamber 62 side of the liquid container attaching/detaching unit 26, and a portion where the pump mechanism 64 provided with a tube pump and the like is disposed, a blindfold plate 65*a* is provided so as to, when the liquid container attaching/detaching 26 is in the state of being extracted from the inserting/extracting opening 42*a*, cause these portions to be invisible from a user.

Further, a vertical wall 67, which faces the back side face of the backward wall 65 of the liquid container attaching/detaching unit 26, is vertically disposed at a position in the vicinity of the back side edge of the apparatus housing 12A on a bottom wall 43 of the apparatus housing 12A, and an apparatus-housing-side connection portion 68, which is capable of being connected to the unit-side connection portion 66 of the liquid container attaching/detaching unit 26, is attached to the front side face of the vertical wall 67. In addition, in each of the unit-side connection portion 66 and the apparatus-housing-side connection portion 68, there is provided a valve mechanism 69 which is made opened in a state in which both of the connection portions 66 and 68 are connected to each other and which is made closed in a state in which both of the connection portions 66 and 68 are disconnected from each other.

Further, as shown in FIG. 2, a coil spring 70 is interposed between the backward wall 65 of the liquid container attaching/detaching unit 26 and the vertical wall 67 of the apparatus housing 12A, so as to be capable of freely expanding/contracting in the frontward/backward direction. The back edge of this coil spring 70 is fixedly attached to, as a fixed edge, the front-side face of the vertical wall 67 of the apparatus housing 12A; while an abutting plate 71 capable of being contacted with the backward wall 65 of the liquid container attaching/detaching unit 26 is attached to, as a free edge, to the front edge of the coil spring 70. That is, the entire length of the coil spring 70 in the state of not being expanded/contracted is longer than that shown in FIG. 2, and the length of the coil spring 70 is set to a length which, when the liquid container attaching/detaching unit 26 is inserted through the mounting portion 42 through the inserting/extracting opening 42*a*, enables the abutting plate 71 to be contacted with the backward wall 65 of the liquid container attaching/detaching unit 26 before the unit-side connection portion 66 and the apparatus-housing-side connection portion 68 become mutually connected.

Further, when, in the above contact state, the liquid container attaching/detaching unit 26 is further inserted backward in an insertion direction in which the liquid container attaching/detaching unit 26 is inserted, the coil spring 70 is contracted by being pushed by the backward wall 65 of the liquid container attaching/detaching unit 26 and, simultaneously therewith, functions as a movement resistance applying portion for applying a frontward energizing force, which energizes the extraction of the liquid container attaching/detaching unit 26 through the inserting/extracting opening 42*a*, to the liquid container attaching/detaching unit 26 as a movement resistance force. Further, the coil spring 70 is configured to, when the unit-side connection portion 66 and the apparatus-housing-side connection portion 68 have become mutually connected after the completion of the mounting of the liquid container attaching/detaching unit 26 into the mounting portion 42, enters a force accumulation state in which a frontward force which energizes the extraction of the liquid container attaching/detaching unit 26 through the inserting/extracting opening 42*a* is accumulated.

In addition, in this case, the liquid container attaching/detaching unit 26 is prevented from being extracted away from the inserting/ejecting opening 42*a* such that the front edge of the liquid container attaching/detaching unit 26 is latched together with the back side face of a convex portion 43*a* which has a cross section of a right-angle triangle shape and which is provided at the front edge of the bottom wall 43 of the apparatus housing 12A. Further, when the front edge of the liquid container attaching/detaching unit 26 is picked up and thereby the stopping state of the liquid container attaching/detaching unit 26 is released, the liquid container attaching/detaching unit 26 is made movable in a direction in which the liquid container attaching/detaching unit 26 is extracted through the inserting/extracting opening 42*a* by the energizing force of the coil spring 70, functioning as an assistance force for assisting the extraction thereof. Further, as shown in FIG. 2, the apparatus-housing-side connection portion 68 is connected to the upstream edge of the ink feeding tube 21*b* which constitutes the apparatus-housing-side path and has a downstream edge connected to the recording head 20. Further, when the unit-side connection portion 66 of the liquid container attaching/detaching unit 26 having been attached to the mounting portion 42 and the apparatus-housing-side connection unit 68 of the apparatus housing 12A have become mutually connected, it becomes possible to feed ink to the recording head 20 from the liquid container 27 via the ink feeding tube 21.

Incidentally, a plurality of the liquid container 27 (whose number is, for example, four) are provided so as to be arranged in the leftward/rightward direction on the supporting plate 60 of the liquid container attaching/detaching unit 26. That is, the liquid container 27 containing black ink, the liquid container 27 containing cyan ink, the liquid container 27 containing magenta ink, and the liquid container 27 containing yellow ink are mounted on the supporting plate 60 so as to be arranged in the leftward/rightward direction. With respect to the plurality of liquid containers 27 each containing a corresponding one of the color inks, the ink pack 44 of the liquid container 27 containing the black ink has a larger ink containable capacity than the ink pack 44 of any other one of the liquid containers 27. In addition, the capacity of the lower layer chamber 62 of the liquid container attaching/detaching unit 26 is larger than the total capacity of the ink packs 44 of all the liquid containers 27 arranged on the supporting plate 60.

Further, on the supporting plate 60, a plurality of the sliding members 61 each associated with a corresponding one of the plurality of liquid containers (whose number is four in this case) are provided, and similarly, a plurality of the ink feeding tubes 21*a* (whose number is four) are each connected to a corresponding one of the sliding members 61. Further, on the supporting plate 60, a plurality of the pump mechanisms 64 (whose number is four) through each of which a corresponding one of the ink feeding tubes 21*a* (whose number is four) is routed are provided, and the downstream edges of the ink feeding tubes 21*a* are each connected to a corresponding one of the unit-side connection portions 66. Further, a plurality of the apparatus-housing-side connection portions 68 (whose number is four) each associated with a corresponding one of the plurality of unit-side connection portions 66 (whose number is four) are provided inside the apparatus housing 12A. Moreover, each of the downstream edges of the plurality of ink feeding tubes 21*b* (whose number is four), the upstream edges of which are each connected to a corresponding one of the apparatus-housing-side connection portions 68, is connected to a corresponding one of the nozzle rows of the recording head 20, each of the nozzle rows being associated with a corresponding one of the ink colors.

As shown in FIG. 2, the ink feeding tube 21*b* constituting the apparatus-housing-side path is routed in the inside of the apparatus housing 12A so as to avoid the mounting portion 42, which is a movement area for the liquid container attaching/detaching unit 26, a movement area for the paper feeding cassette 25, and the transportation paths 33, 34, and 39 for the paper P. Further, although not illustrated, signal wirings, which electrically connect between the connection terminal 58 of the liquid container 27 and the board unit 22 as a controller of the recording apparatus 12, are routed along the ink feeding tubes 21*a* constituting the unit-side paths and the ink feeding tubes 21*b* constituting the apparatus-housing-side paths. Moreover, a connection mechanism (omitted from illustration) capable of electrically connecting between unit-side signal wirings and apparatus-housing-side signal wirings is provided in each of the unit-side connection unit 66 and the apparatus-housing-side connection portion 68.

Next, behaviors of the recording apparatus 12 of this embodiment, having been configured in such a way as described above, will be described below focusing attention on behaviors when a user performs attaching/detaching replacement of the liquid container 27.

For example, in the state shown in FIG. 2, when old-to-new replacement of the liquid container 27 containing ink to be fed to the recording head 20 is performed, the liquid container attaching/detaching unit 26 is extracted through the inserting/extracting opening 42*a* of the apparatus housing 12A. Further, an old liquid container 27 is detached from the upper face of the supporting plate 60 of the liquid container attaching/detaching unit 26. That is, when one push operation of the attachment 46 of the old liquid container 27 toward the sliding member 61 is performed, a connection state in which the attachment 46 of the old liquid container 27 and the sliding member 61 are joined each other is released, and the old liquid container 27 becomes in the state of being detachable from the upper face of the supporting plate 60.

Further, next, a new liquid container 27 as a substitution for the detached old liquid container 27 is mounted on the supporting plate 60, and when one push operation of the attachment 46 toward the sliding member 61 is further performed in a state in which the attachment 46 and the sliding member 61 are abutted to each other, the new liquid container 27 becomes in the state of causing the attachment 46 to be joined with the sliding member 61, and the new liquid container 27 becomes in an attached state. As a result, it becomes possible to feed ink from the new liquid container 27 to the ink feeding tube 21*a* constituting the unit-side path. Simultaneously therewith, communication from the connection terminal 58 of the new liquid container 27 to signal wirings routed along the ink feeding tube 21*a* becomes possible.

Further, next, the liquid container attaching/detaching unit 26 to which a new liquid container 27 has been attached in such a way as described above is inserted through the inserting/extracting opening 42*a* of the apparatus housing 12A. Subsequently, the backward wall 65, which is located at a forward position in the insertion direction of the liquid container attaching/detaching unit 26, is contacted with the abutting plate 71 which is attached to the tip of the coil spring 70, and the movement speed of the liquid container attaching/detaching unit 26 in the insertion direction degreases due to the influence of an elastic force of the coil spring 70. Further, when, in such a connection state, a user further pushes the liquid container attaching/detaching unit 26 forward in the insertion direction, as shown in FIG. 2, the liquid container attaching/detaching unit 26 enters a state of causing the coil spring 70 to be contracted and enter a force accumulation state, and causing both of the connection portions 66 and 68 to be connected to each other, and the mounting of the liquid container attaching/detaching unit 26 into the mounting portion 42 inside the apparatus housing 12A is brought to completion.

Further, the connection between the unit-side connection portion 66 and the apparatus-side connection portion 68 causes the valve mechanism provided in each of the both connection portions 66 and 68 to open and, as a result, it becomes possible to feed ink from the ink feeding tube 21*a* constituting the unit-side path to the ink feeding tube 21*b* constituting the apparatus-side path. Further, when, in this state, the pump mechanism 64 is driven, the ink is favorably fed to the recording head 20 which is located at an upper position than that of the liquid container 27 in the vertical direction.

Meanwhile, when, in this state, the liquid container attaching/detaching unit 26 is moved in a direction in which the inserting/extracting opening 26 of the apparatus housing 12A is extracted through the inserting/extracting opening 42*a*, the unit-side connection portion 66 and the apparatus-housing-side connection portion 68 become in a disconnected state and, as a result, the valve mechanism 69 provided in each of the both connection portions 66 and 68 closes. Thus, ink inside each of the ink feeding tubes 21*a* and 21*b* is suppressed from being leaked from a corresponding one of the both connection portions 66 and 68. Further, when the liquid container attaching/detaching unit 26 is extracted from the inserting/extracting opening 42*a*, the energizing force of the coil spring 70 pushes, as an assisting force, the liquid container attaching/detaching unit 26, and thus, it becomes possible for a user to easily perform an extraction operation.

Further, if ink is leaked from the liquid container 27 attached to the liquid container attaching/detaching unit 26, the leaked ink flows into the lower layer chamber 62 and is stored therein. Further, in such a case, even if all inks are leaked from all the liquid containers 27 and flow into the lower layer chamber 62, any ink is not leaked out from the lower layer chamber 62. Thus, it becomes possible to suppress the apparatus housing 12*a* from being tainted by the leaked ink.

According to this embodiment, it is possible to obtain the following advantageous effects.

(1) It is possible to easily attach/detach the liquid container 27 to/from the liquid container attaching/detaching unit 26 in a state of having being extracted from the inserting/extracting opening 42*a*. Further, when the liquid container attaching/detaching unit 26 containing the liquid container 27 attached therein has been inserted through the inserting/extracting opening 42*a*, the ink feeding tube 21*a* and the ink feeding tube 21*b*, which are associated with the unit-side path and the ink the apparatus-housing-side path, respectively, and which separately constitute the liquid feeding path, are connected to each other and, as a result, it becomes possible to feed ink from the liquid container 27 to the recording head 20. Further, in such a case, since the liquid container 27 is disposed inside the apparatus housing 12A, the installation area of the entire recording apparatus 12 does not increase. Accordingly, it is possible to, without increasing the installation area of the entire apparatus, easily feed ink to the recording head 20 from the liquid container 27, which is likewise disposed inside the apparatus housing 12A, through the ink feeding tube 21 which is an example of the liquid feeding path.

(2) When the liquid container attaching/detaching unit 26 containing the liquid container 27 therein has been inserted through the inserting/extracting opening 42*a* and the unit-side connection portion 66 and the apparatus-side connection portion 68 become mutually connected, the valve mechanism 69 provided in both of the connection portions 66 and 68 becomes is open state. Thus, the ink feeding tube 21*a* constituting the unit-side path and the ink feeding tube 21*b* constituting the apparatus-housing-side path are connected to each other and, as a result, it becomes possible to feed ink from the liquid container 27 to the recording head 20. In contrast, when the liquid container attaching/detaching unit 26 is extracted through the inserting/extracting 42*a* and both of the connection portions 66 and 68 are disconnected from each other, the valve mechanism 69 provided in both of the connection portions 66 and 68 becomes closed. Thus, when, for example, for the purpose of attachment/detachment replacement of the liquid container 27, the liquid container attaching/detaching unit 26 has been extracted through the inserting/extracting opening 42*a* of the apparatus housing 12A, it is possible to suppress the ink from leaking from the ink feeding tube 21*a* constituting the unit-side path and the ink feeding tube 21*b* constituting the apparatus-housing-side path.

(3) For example, even when the liquid container attaching/detaching unit 26 has been extracted forcibly by a user through the inserting/extracting opening 42*a* of the apparatus housing 12A, it is possible to prevent, by utilizing the behavior of the coil spring 70 functioning as the movement resistance applying portion, the occurrence of a situation in which the unit-side connection portion 66 and the apparatus-housing-side connection portion 68 collide with each other due to the force applied by the user.

(4) When the liquid container attaching/detaching unit 26 is extracted through the inserting/extracting opening 42*a*, the coil spring 70, which is an example of the force applying member, enters a state in which an accumulated force is released as an energizing force applied in the extraction direction, and thus, an operation of extracting the liquid container attaching/detaching unit 26 becomes easy.

(5) For example, even when the liquid container attaching/detaching unit 26 is disposed at a lower portion in the vertical direction in the apparatus housing 12A; while the recording head 20 is disposed at an upper portion in the vertical direction in the apparatus housing 12A, it is possible to smoothly feed ink from the liquid container 27 attached to the liquid container attaching/detaching unit 26 to the recording head 20 by utilizing the drive of the pump mechanism 64.

(6) It is possible to perform multi-color recording with a plurality of inks onto the paper P which is an example of a medium.

(7) In the liquid container attaching/detaching unit 26, the sliding member 61 is disposed in the vicinity of the front edge of the supporting plate 60, and thus, a user can perform attachment/detachment of the liquid container 27 even when only the around half of the liquid container attaching/detaching unit 26 is in a state of being extracted from the inserting/extracting opening 42*a*.

In addition, the aforementioned embodiment may be modified as described below.

As denoted by a chain double-dashed line in FIG. 2, an abutting member 72 may be provided in the vertical direction so as to extend from the lower face of the partitioning wall 28, which is a ceiling of the mounting portion 42, and be capable of abutting onto the vertical wall 55 of the attachment 46 of the liquid container 27. In this case, the attachment 46 for the liquid container 27 is caused to be aligned with the sliding member 61 on the supporting plate 60, and further, even when the liquid container 27 is placed at a position distanced from the sliding member 61, in the process of inserting the liquid container attaching/detaching unit 26, the abutting member 72 abuts onto the vertical wall 55 and thereby causes the liquid container 27 to move to the sliding member 61 side. Accordingly, a user does not need to perform alignment of the liquid container 27 so as to strictly cause the attachment 46 and the sliding member 61 to be in the abutted state, and thus, this mechanism enables improvement of the efficiency of an operation for attachment/detachment of the liquid container 27.

Figure 4:
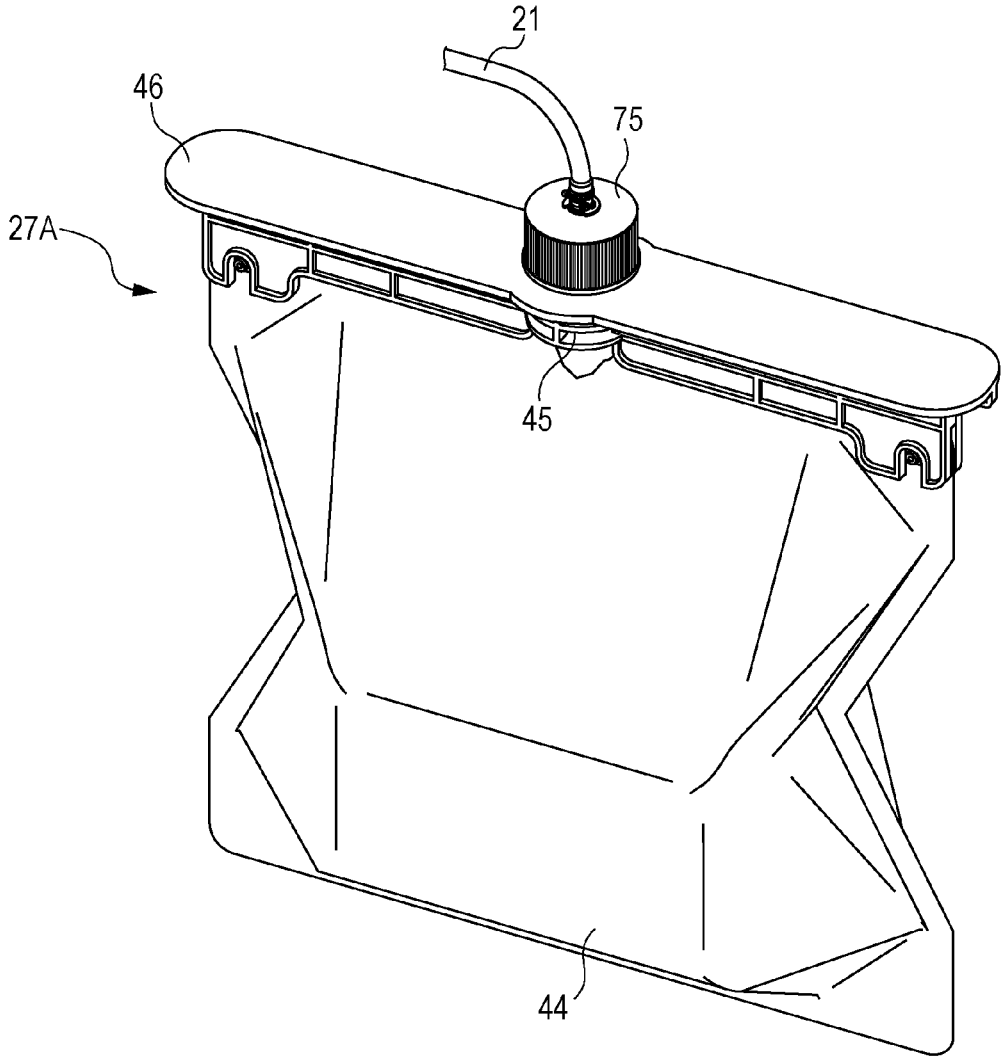
FIG. 4 is a perspective view of a liquid container in a modification example of an embodiment of the invention.

As shown in FIG. 4, the liquid container 27A may not be configured so as to be connected to the ink feeding tube 21 when the attachment 46 has become in the state of being joined with the sliding member 61, but may be configured so as to be connected to the ink feeding tube 21 by causing a cap member 75, which is attached to the upstream edge of the ink feeding tube 21, to be fitted into the edge of the liquid lead-out member 45 having been passed through the attachment 46. Through this mechanism, it is also possible to connect the liquid container 27A to the ink feeding tube 21 on the liquid container attaching/detaching unit 26 in a manner intending the suppression of the ink leakage.

Figure 5:
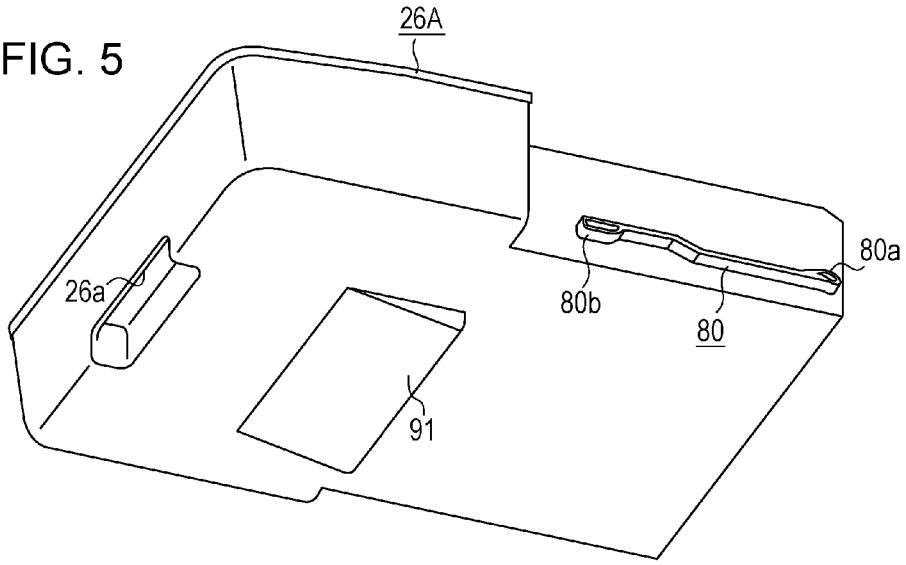
FIG. 5 is a perspective view of a liquid container attaching/detaching unit in a modification example of an embodiment of the invention when the liquid container attaching/detaching unit is seen obliquely from the front lower right side thereof.
Figure 6A:
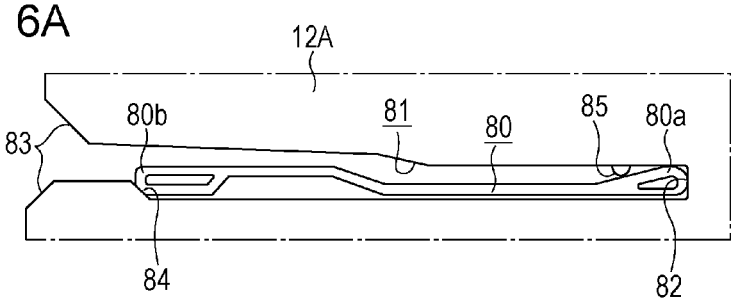
FIG. 6A is a schematic diagram that describes a positional relation between a guide rail and a guide slot as well as a state in which the insertion of a liquid container attaching/detaching unit is completed, in a modification example of an embodiment of the invention.
Figure 6B:
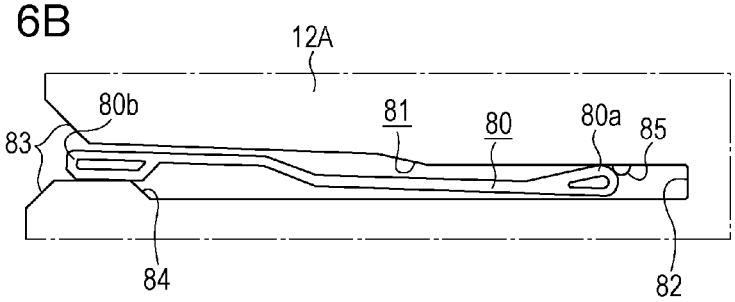
FIG. 6B is a schematic diagram that describes a positional relation between a guide rail and a guide slot as well as a state in which the insertion of a liquid container attaching/detaching unit is in the process of insertion or extraction, in a modification example of an embodiment of the invention.

As shown in FIGS. 5, 6A, and 6B, a guide rail 80 made of a resin material may be formed on each of the side faces of a liquid container attaching/detaching unit 26A, and a guide slot 81 may be formed on each of the inner side faces of the mounting portion 42 inside the apparatus housing 12A. In this case, the guide rail 80 forms a convex shape extending approximately along the insertion direction of the liquid container attaching/detaching unit 26A from the inserting/extracting opening 42*a*, and includes an insertion-side edge portion 80*a* and an extraction-side edge portion 80*b*, each forming a ring shape having an inside space.

Meanwhile, the innermost portion of the guide slot 81 is made a striking portion 82 which is struck by the insertion-side edge portion 80*a* of the guide rail 80. Further, the entrance portion of the guide slot 81 is formed into a taper face 83, and the inner bottom face of a portion distanced from the taper face 83 by a short distance in a direction toward the innermost portion of the guide slot 81 is formed into an oblique face 84 which abuts onto the extraction-side edge portion 80*b* of the guide rail 80 in the state of having been inserted in the guide slot 81, so as to be capable of restricting the extraction of the guide rail 80 from the inside of the guide slot 81. Moreover, a protruding portion 85 may be formed on a portion of the ceiling face in the vicinity of the innermost portion of the guide slot 81 so as to be capable of applying a movement resistance force to the insertion-side edge portion 80*a* by being slidingly contacted with the insertion-side edge portion 80A.

In the case where this mechanism is implemented, when the liquid container attaching/detaching unit 26A is forcibly inserted by a user through the inserting/extracting opening of the apparatus housing 12A, the protruding portion 85 provided inside the guide slot 81 functions as a movement resistance applying portion; thereby, without providing the coil spring 70, causing the speed of the movement of the liquid container attaching/detaching unit 26A in the insertion direction to be reduced.

Figure 7:
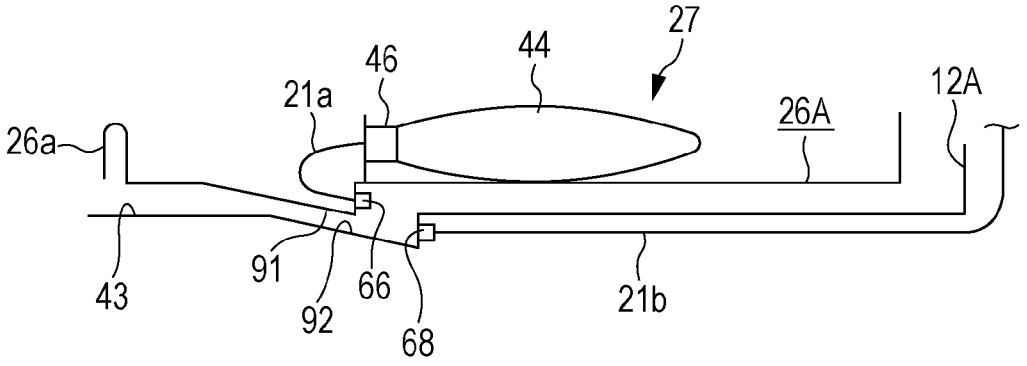
FIG. 7 is a schematic diagram illustrating a positional relation between a unit-side connection portion and an apparatus-housing-side connection portion in a modification example of an embodiment of the invention.

As shown in FIGS. 5 and 7, a convex portion 91 whose cross-section face forms a right-angle triangle may be formed at the lower face of the liquid container attaching/detaching unit 26A, and a concave portion 92 whose cross-section face forms a right-angle triangle may be formed on the upper face of the bottom wall 43 of the apparatus housing 12A so as to be capable of being fitted to the convex portion 91. Further, the liquid container attaching/detaching unit 26A may be configured such that the unit-side connection portion 66 is provided on a vertical edge face constituting the convex portion 91 and facing backward, and the ink feeding tube 21*a* constituting the unit-side path is connected to the unit-side connection portion 66. Further, the apparatus housing 12A may be configured such that the apparatus-side connection portion 68 is provided on a vertical edge face constituting the concave portion 92 and facing frontward, and the ink feeding tube 21*b* constituting the apparatus-housing-side path is connected to the apparatus-side connection portion 68.

Through this mechanism, the liquid container attaching/detaching unit 26A does not need to be configured to have the two upper and lower layers. Further, this mechanism suppresses the increase of the depth size of the apparatus housing 12A, and further makes it possible to connect the ink feeding tube 21*a* constituting the unit-side path to the ink feeding tube 21*b* constituting the apparatus-side path through an operation of inserting the liquid container attaching/detaching unit 26A. Accordingly, this mechanism makes an operation of connecting the ink feeding tubes 21*a* and 21*b* simple and easy, and contributes to downsizing of the recording apparatus 12.

The inserting/extracting opening 42*a* may be formed not at the front face of the apparatus housing 12A but at either the left side or the right side thereof, and the liquid container attaching/detaching unit 26/26A may be configured to be inserted or extracted in the leftward/rightward direction.

The liquid container attaching/detaching unit 26/26A may be configured to mount not only the liquid container 27/27A but also a waste liquid tank which collects waste ink having been ejected, as waste liquid, by the recording head 20 via a waste liquid collecting tube.

The liquid container 27/27A attached to the liquid container attaching/detaching unit 26/26A may be configured to include an inlet through which ink can be refilled and which is normally closed by a cover member and is made capable of being refilled when needed. Through this mechanism, it is possible to fixedly dispose the liquid container 27/27A.

The total number and the kinds of the liquid containers 27/27A attached/detached to/from the liquid container attaching/detaching unit 26/26A may be optionally determined, and, as an example, only a single container 27/27A of a large capacity for black ink may be attached to the liquid container attaching/detaching unit 26/26A.

The pump mechanism 64 may not necessarily be provided in the liquid container attaching/detaching unit 26. Further, as a kind of pump for the pump mechanism 64, in addition to the tube pump, any one of various kinds of pumps, such as a diaphragm pump and a piston pump, can be employed.

As a kind of the force applying member which also functions as the movement resistance applying portion, in addition to such a coil spring as the coil spring 70, any one of various kinds of spring, such as a helical spring and a plate spring, can be employed.

As the valve mechanism 69, various kinds of valve mechanism, such as an electromagnetic valve which takes a close-to-open action upon detection of contact between both of the connection portions 66 and 68, and another valve mechanism in which, when both of the connection portions 66 and 68 have been contacted with each other, each of valves of the both connection portions 66 and 68 is pushed by a member protruding from the opposite connection portion, and moves backward, while moving against energizing force, from a position where the valve is closed to a position where the valve is opened, can be employed.

In the liquid container attaching/detaching unit 26 shown in FIG. 2, the sliding member 61 may be disposed in the vicinity of a back edge portion on the supporting plate 60. Through this mechanism, the length of the ink feeding tube 21*a* constituting the unit-side path can be made short.

In the aforementioned embodiment, the recording apparatus 12 is embodied into a serial printer, but may be a line printer or a page printer.

In the aforementioned embodiment, the recording apparatus 12 may be a liquid ejecting apparatus that sprays or ejects liquids other than inks. In addition, when a liquid is ejected from a liquid ejecting apparatus in the form of minute liquid droplets, the minute liquid droplets include grain-shaped droplets, teardrop-shaped droplets, and trailing-string-shaped droplets. Further, as the liquid mentioned above, any material capable of being ejected from a liquid ejecting apparatus can be employed. For example, any substance in the state of being in a liquid phase can be used, and such substances include high-viscosity or low-viscosity liquid objects, sol, gel water, other organic solvents, inorganic solvents, solutions, liquid resins, and fluid objects, such as liquid metals (metallic melts). Further, not only a liquid as one of states of a substance, but also an object obtained by dissolving, dispersing, or mixing particles of a functional material made of a solid, such as a pigment or a metallic particle, into a solvent, or the like, is included. As representative examples of the liquid, ink such as described in the aforementioned embodiment, liquid crystal, and the like, can be given. Here, the ink encompasses aqueous ink and oil-based ink, which are commonly used, as well as various liquid constituents, such as gel ink and hot-melt ink.

Specific examples of the liquid ejecting apparatus include a liquid crystal display, an electroluminescence (EL) display, and a plane emission display, as well as a liquid ejecting apparatus that ejects a liquid including a material, such as an electrode material or a color material, for use in manufacturing of color filters, and the like, in the form of dispersion or dissolution. Further, the liquid ejecting apparatus may be a liquid ejecting apparatus that ejects a living organic material for use in manufacturing of biotips, a liquid ejecting apparatus that ejects a liquid which is used as a precise pipet and becomes a sample, a print apparatus, a micro dispenser, or the like. Moreover, the liquid ejecting apparatus may be a liquid ejecting apparatus that ejects, in a pinpoint manner, lubricating oil onto a precision machine, such as a watch or a camera, or a liquid ejecting apparatus that ejects a transparent resin liquid, such as an ultraviolet hardening resin liquid, for use in forming a minute hemispheric lens (optical lens) used in optical communication elements, and the like, onto a substrate. Further, the liquid ejecting apparatus may be a liquid ejecting apparatus that ejects an acid or alkaline etching liquid for use in etching of a substrate or the like.

The entire disclosure of Japanese Patent Application No. 2014-012128, filed Jan. 27, 2014 is expressly incorporated by reference herein.

What is claimed is:

1. A recording apparatus comprising:

a recording head that is disposed inside an apparatus housing and that ejects a liquid onto a medium;

a liquid container attaching/detaching unit that is configured to be inserted/extracted to the apparatus housing;

the liquid container attaching/detaching unit configured to attach/detach to/from a liquid container which contains a liquid, a liquid feeding path that feeds the liquid from the liquid container to the recording head, wherein the liquid feeding path includes a unit-side path provided in the liquid container attaching/detaching unit and an apparatus-housing-side path provided in the apparatus housing, and wherein the unit-side path and the apparatus-housing-side path are connected by the insertion of the liquid container attaching/detaching unit to the apparatus housing, and the connection is disconnected by the extraction of the liquid container attaching/detaching unit to the apparatus housing, wherein a paper cassette feeds a medium, wherein an inserting/extracting direction of the liquid container attaching/detaching unit is a same inserting/extracting direction as the paper cassette.

2. The recording apparatus according to claim 1, wherein each of a unit-side connection portion constituting the unit-side path and connected to the apparatus-housing-side path and an apparatus-housing-side connection portion constituting the apparatus-housing-side path and connected to the unit-side path includes a valve mechanism which is opened when both of the unit-side connection portion and the apparatus-housing-side connection portion are connected to each other, and which is closed when both of the unit-side connection portion and the apparatus-housing-side connection portion are disconnected from each other.

3. The recording apparatus according to claim 2, further comprising:

a movement resistance applying portion that, before the unit-side path and the apparatus-housing-side path are mutually connected after initiating the insertion of the liquid container attaching/detaching unit through the inserting/extracting opening, makes contact with and applies a movement resistance force to the liquid container attaching/detaching unit while moving in an insertion direction in which the liquid container attaching/detaching unit is inserted, wherein the liquid container attaching/detaching unit further moves in the insertion direction while moving against the movement resistance force applied by the movement resistance applying portion, and the movement of the liquid container attaching/detaching unit brings the unit-side path into contact with the apparatus-housing-side path.

4. The recording apparatus according to claim 3, wherein the movement resistance applying portion is configured to include a force applying member that, when the movement resistance applying portion is in contact with the liquid container attaching/detaching unit which further moves in the insertion direction, applies an energizing force to the liquid container attaching/detaching unit in a direction in which the liquid container attaching/detaching unit is extracted through the inserting/extracting opening, and that, when the movement resistance applying portion is in contact with the liquid container attaching/detaching unit and the unit-side path and the apparatus-housing-side path are connected to each other, enters a force accumulation state.

5. The recording apparatus according to claim 1, wherein the liquid container attaching/detaching unit further includes a pump mechanism that is driven in order to cause the liquid to move and flow, through the unit-side path, from an upstream side, at which the liquid container is disposed, toward a downstream side.

6. The recording apparatus according to claim 1, wherein, in the liquid container attaching/detaching unit, a plurality of liquid containers including the liquid container are attached/detached to/from the liquid container attaching/detaching unit itself, and a plurality of unit-side paths which include the unit-side path and each of which is associated with a corresponding one of the plurality of liquid containers are provided; while, in the apparatus housing, a plurality of apparatus-housing-side paths which include the apparatus-housing-side path and each of which is associated with a corresponding one of the plurality of unit-side paths are provided.

7. The recording apparatus according to claim 1, wherein an inserting/extracting position of the liquid container attaching/detaching unit is under the paper cassette.

8. A recording apparatus comprising:

a recording head that is disposed inside an apparatus housing and that ejects a liquid onto a medium;

a liquid container attaching/detaching unit that is configured to be inserted/extracted to the apparatus housing, the liquid container attaching/detaching unit being configured to attach/detach to/from a liquid container which contains a liquid, and a liquid feeding path that feeds the liquid from the liquid container to the recording head, a unit side connection portion provided in the liquid container attaching/detaching unit, an apparatus-housing-side connection portion provided in the apparatus housing, wherein the unit-side connection portion and the apparatus-housing-side connection portion are connected by the insertion of the liquid container attaching/detaching unit to the apparatus housing, and the connection is disconnected by the extraction of the liquid container attaching/detaching unit to the apparatus housing, wherein a paper cassette feeds a medium, an inserting/extracting direction of the liquid container attaching/detaching unit is the same inserting/extracting direction as the paper cassette.

9. The recording apparatus according to claim 8, wherein an inserting/extracting position of the liquid container attaching/detaching unit is under the paper cassette.

10. The recording apparatus according to claim 8, wherein each of a unit-side connection portion constituting the unit-side path and connected to the apparatus-housing-side path and an apparatus-housing-side connection portion constituting the apparatus-housing-side path and connected to the unit-side path includes a valve mechanism which is opened when both of the unit-side connection portion and the apparatus-housing-side connection portion are connected to each other, and which is closed when both of the unit-side connection portion and the apparatus-housing-side connection portion are disconnected from each other.

11. The recording apparatus according to claim 10, further comprising:

a movement resistance applying portion that, before the unit-side path and the apparatus-housing-side path are mutually connected after initiating the insertion of the liquid container attaching/detaching unit through the inserting/extracting opening, makes contact with and applies a movement resistance force to the liquid container attaching/detaching unit while moving in an insertion direction in which the liquid container attaching/detaching unit is inserted, wherein the liquid container attaching/detaching unit further moves in the insertion direction while moving against the movement resistance force applied by the movement resistance applying portion, and the movement of the liquid container attaching/detaching unit brings the unit-side path into contact with the apparatus-housing-side path.

12. The recording apparatus according to claim 11, wherein the movement resistance applying portion is configured to include a force applying member that, when the movement resistance applying portion is in contact with the liquid container attaching/detaching unit which further moves in the insertion direction, applies an energizing force to the liquid container attaching/detaching unit in a direction in which the liquid container attaching/detaching unit is extracted through the inserting/extracting opening, and that, when the movement resistance applying portion is in contact with the liquid container attaching/detaching unit and the unit-side path and the apparatus-housing-side path are connected to each other, enters a force accumulation state.

13. The recording apparatus according to claim 8, wherein the liquid container attaching/detaching unit further includes a pump mechanism that is driven in order to cause the liquid to move and flow, through the unit-side path, from an upstream side, at which the liquid container is disposed, toward a downstream side.

14. The recording apparatus according to claim 8, wherein, in the liquid container attaching/detaching unit, a plurality of liquid containers including the liquid container are attached/detached to/from the liquid container attaching/detaching unit itself, and a plurality of unit-side paths which include the unit-side path and each of which is associated with a corresponding one of the plurality of liquid containers are provided; while, in the apparatus housing, a plurality of apparatus-housing-side paths which include the apparatus-housing-side path and each of which is associated with a corresponding one of the plurality of unit-side paths are provided.

* * * * *